US005974152A

United States Patent [19]

Fujinami

[11] Patent Number: 5,974,152

[45] Date of Patent: Oct. 26, 1999

[54] SOUND IMAGE LOCALIZATION CONTROL DEVICE

[75] Inventor: Yoshihisa Fujinami, Sagamihara, Japan

[73] Assignee: Victor Company of Japan, Ltd., Yokohama, Japan

[21] Appl. No.: 08/800,925

[22] Filed: Feb. 13, 1997

[30] Foreign Application Priority Data

May 24, 1996 [JP] Japan ..... 8-153336

[51] Int. Cl.[6] ..... H04R 5/00

[52] U.S. Cl. ..... 381/1; 381/300; 381/303; 381/310; 381/309

[58] Field of Search ..... 381/1, 17–18, 381/19–24, 61–63, 300, 303, 307, 309, 310, 26–28, 77, 80

[56] References Cited

U.S. PATENT DOCUMENTS 5,404,406 4/1995 Fuchigami et al. .

*Primary Examiner*—Huyen Le
*Assistant Examiner*—Duc Nguyen
*Attorney, Agent, or Firm*—Michael N. Meller

[57] ABSTRACT

A sound image localization control device reproduces an acoustic signal on the basis of a plurality of simulated delay times and a plurality of simulated filtering characteristics as if a sound image ware located on an arbitrary position other than positions of separately arranged transducers. A convolver which is main device of the sound image localization control device comprise of a plurality of delay elements having the plurality of simulated delay times for delaying an audio signal to constitute a direct sound signal and a plurality of reflection sound signals. And the convolver includes a plurality of Infinite Impulse Response filters for filtering the direct sound signal and the plurality reflection sound signals on the basis of the plurality of simulated filtering characteristics respectively. The plurality of the Infinite Impulse Response filters includes filters having filtering characteristic which emphasize lower frequency said of predetermined reflection sound signals among the plurality of the reflection sound signals compared with the plurality of simulated filtering characteristics corresponding to the predetermined reflection sound signals. Output signals of the plurality of the IIR filters are added each other by adder, then filtered by a Finite Impulse Response filter.

4 Claims, 9 Drawing Sheets

SOUND IMAGE LOCALIZATION CONTROL DEVICE

BACKGROUND OF THE INVENTION

The present invention relates to a sound image localization control device for processing sound image localizing signals. The localization of a sound image provided by a 2-channel speaker or a 2-channel headphones is to localize the sound image as if it were located in a position other than a position of the speaker or the headphone. In order to realize such sound image localization, digital filters are used which are constructed such that sound pressure around eardrums of a listener which is caused by a virtual sound source at a desired location becomes equal to a sound pressure caused by the speakers or the headphone by allowing crosstalk in a head related transfer function (HRTF) measured at a head of a listener or a dummy head in a case of the 2-channel speaker or by partially cancelling a headphone characteristics or providing crosstalk in the headphone characteristics in a case of the headphone.

FIG. 1 shows a principle of a sound image localization control device proposed by the same assignee of this application and disclosed in Japanese Patent Application Laid-open No. H6-17839.

According to the device shown in FIG. 1, transfer function cfLx and cfRx at a desired location x are preliminarily provided as coefficients for realizing the device by convolver processing in such as Finite Impulse Response filters (FIR filters) or Infinite Impulse Response Filters (IIR filters) and, in a case where a sound source X is to be located at a desired position, the transfer function cfLx based on an actual measurement and stored in an ROM is transferred to the FIR digital filter to perform a convolution progressing of signals from the sound source X and to reproduce the thus processed signals by a pair of speakers SP1 and SP2.

Data preliminarily stored in the ROM are obtained through a measuring system shown in FIG. 2.

According to the system shown in FIG. 2, a pair of microphones ML and MR are set on ears of a dummy head (or human head) DM. Sound from a speaker SP which includes source sounds (reference data) refL and refR and sounds to be measured (measurement data) L, and R is received by the microphones ML and MR and the reference data refL and refR and the measurement data L and R are recorded in recorder DATs in synchronism with each other. The transfer function which is wave-shaped in a predetermined manner on the basis of the recorded data is thus obtained.

In case where the sound source localization is performed by the above mentioned convolver processing, such problems as better feeling of distance with longer impulse response time of the processing system, inversion of forward and rearward sound images, rise of localized sound image (imaginary sound image) in which a listener hears sound from a high level position and localization of a front median sound image in a listener's head in which a sound image located in front of the listener is located in his head may hardly occur.

The simplest method for realizing this localization processing utilizing the convolver processing is to prepare a FIR filter having long convolution coefficient length and to convolute a long filter coefficient determined on the basis of HRTF measured in an echo room by using the above mentioned system.

Since, however, the size of hardware is usually limited, it is impossible to make the impulse response time arbitrarily long. In general, in order to solve this problem, an echo sound structure in the echo room is simulated and a resultant echo sound is added to the sound.

FIG. 3(B) shows a filter construction which is considered generally in lieu of the FIR filter. The filter shown in FIG. 3(B) is constructed with delay elements (D0 to D6) and IIR filters. The impulse response waveform in this construction is shown in FIG. 3(C).

On the other hand, FIG. 3(A) shows the impulse response waveform when the filter is constructed with using FIR filters having long convolution coefficients. The impulse response waveform shown in FIG. 3(A) is similar to a desired impulse response waveform. As is clear from these waveforms, when the filter is constructed with the IIR filters, the reproducibility of response waveform similar to the desired impulse response waveform is low. That is, although the filter constructed with IIR filters is advantageous in that it can be realized with simplified construction simplified by an extent corresponding to in the order of a single digital signal processor IC chip, it is defective in that a listener hears sounds as if a sound image were located within his head or in the vicinity of a surface of the head or in an elevated level, so that the distance feeling to a sound image is lost.

SUMMARY OF THE INVENTION

An object of the present invention is to provide a sound image localization control device having a simple construction and being capable of realizing a very natural sound image localization with enough distance feeling to a sound image and without rise of the sound image level.

Another object of the present invention is to provide a sound image localization control device for reproducing, from separated transducers, an acoustic signal on basis of a plurality of simulated delay times and a plurality of simulated filtering characteristics as if a sound image were located in an arbitrary position other than positions of separately arranged transducers, comprising delay means having a plurality of delay elements having the plurality of simulated delay times for delaying an audio signal to constitute the acoustic signal with a direct sound signal and a plurality of reflection sound signals related to the direct sound signal, a plurality of IIR filter means for filtering the direct sound signal and the plurality of the reflection sound signals obtained by the plurality of the delay elements of the delay means on the basis of the plurality of simulated filtering characteristics respectively, the plurality of the IIR filter means including filters having filtering characteristics which emphasize lower frequency side of predetermined reflection sound signals among the plurality of the reflection sound signals compared with the plurality of simulated filtering characteristics corresponding to the predetermined reflection sound signals, and adder means for adding output signals of the plurality of the IIR filter means.

In an aspect of the present invention, the sound image localization control device further comprises FIR filter means for filtering an output signal of the adder means.

In another aspect of the present invention, the predetermined delay time and an impulse response time of the plurality of the IIR filter means are set such that reverberation time at the output of the adder means becomes about 45 ms.

In a further aspect of the present invention, the predetermined delay times, an impulse response time of the plurality of the IIR filter means and an impulse response time of the FIR filter means are set such that reverberation time at the output of the FIR filter means becomes about 45 ms.

In a further aspect of the present invention, the filter of the plurality of the IIR filter means, having the filtering characteristic which emphasizes the lower frequency side of the reflection sound signal compared with the simulated filtering characteristic corresponding to the reflection sound signal is provided at positions corresponding to about 35 ms in delay time.

In another aspect of the present invention, the filtering characteristics emphasize the lower frequency side of the predetermined reflection sound signals by about 6 dB compared with the plurality of simulated filtering characteristics corresponding to the predetermined reflection sound signals.

DETAILED DESCRIPTION OF THE PREFERRED EMBODIMENTS

Preferred embodiments of the present invention will be described with reference to the accompanying drawings. The present invention was made on the basis of an analysis of a specific sound structure and the analysis will be described first.

The sound structure analysis of sound image localization may be performed by Fourier analysis. In such case, however, time instance at which a component effective to localize a sound image occurs is uncertain. Therefore, in the present invention, the sound structure for sound image localization is analysed by using wavelet analysis.

This analysis is one currently drawing attention and is a mathematically refined analysis according to the conventional constant quality factor filter bank. According to this analysis, an input signal is analysed in both time and frequency by using a localized analysis waveform called "analysing wavelet".

Since, according to this analysis, it is possible to specify a time instance at which a certain phenomenon occurs, this analysis is advantageous for an analysis of a signal containing echo sounds.

Figures 4A, 4B:
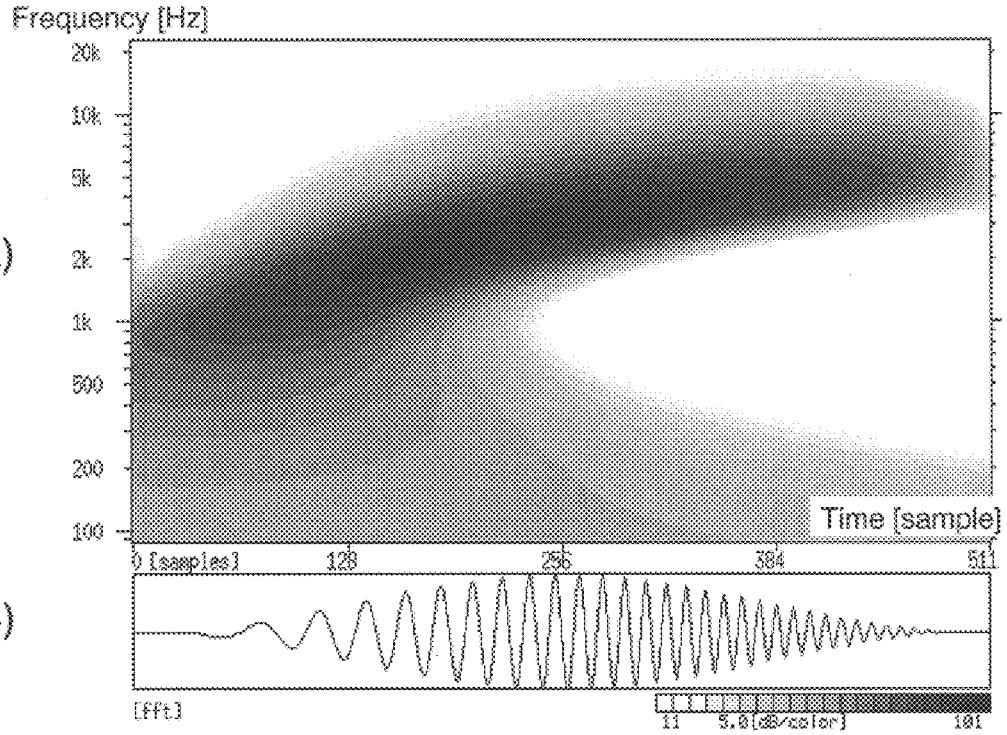
FIG. 4(A) shows a general wavelet conversion waveform according to the wavelet analysis.
FIG. 4(B) shows a time waveform of a signal to be analyzed in FIG. 4(A)

FIGS. 4(A) and 4(B) show a typical example of a result of wavelet conversion of a signal having frequency varying from 1 kHz to 5 kHz.

That is, FIG. 4(A) is a wavelet-converted waveform and FIG. 4(B) shows a time waveform of the signal to be analysed.

Figure 1:
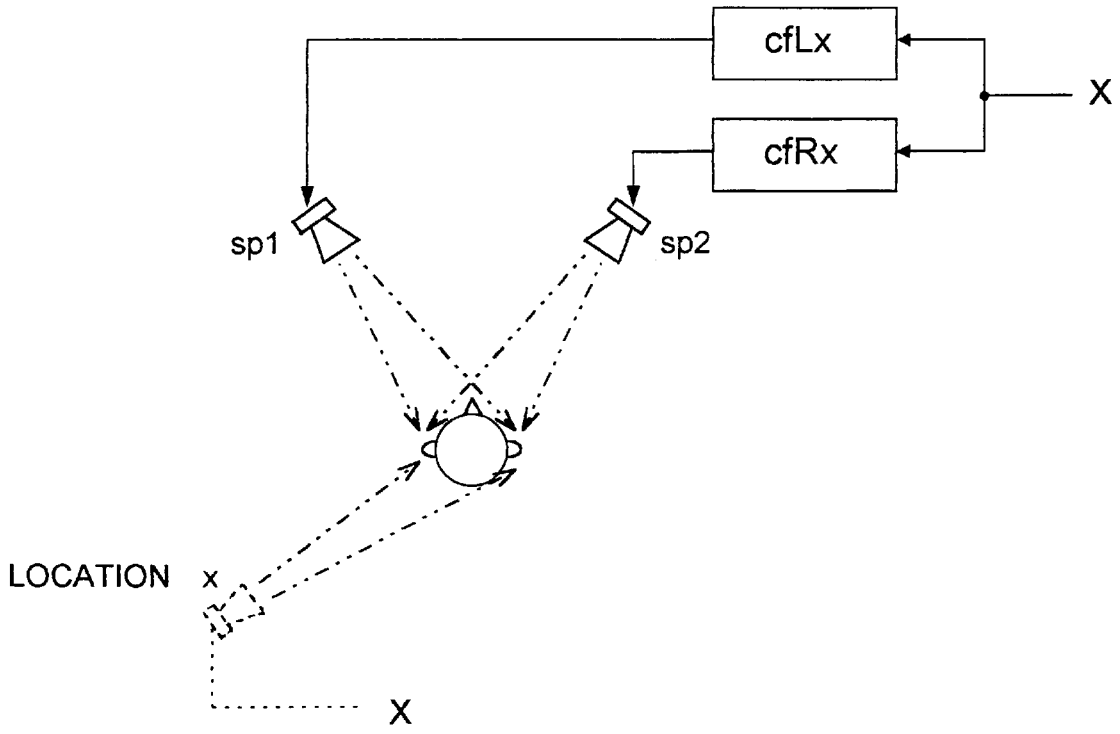
Fig. 1 (PRIOR ART)
FIG. 1 shows a principle of a conventional sound image localization control device.
Figure 2:
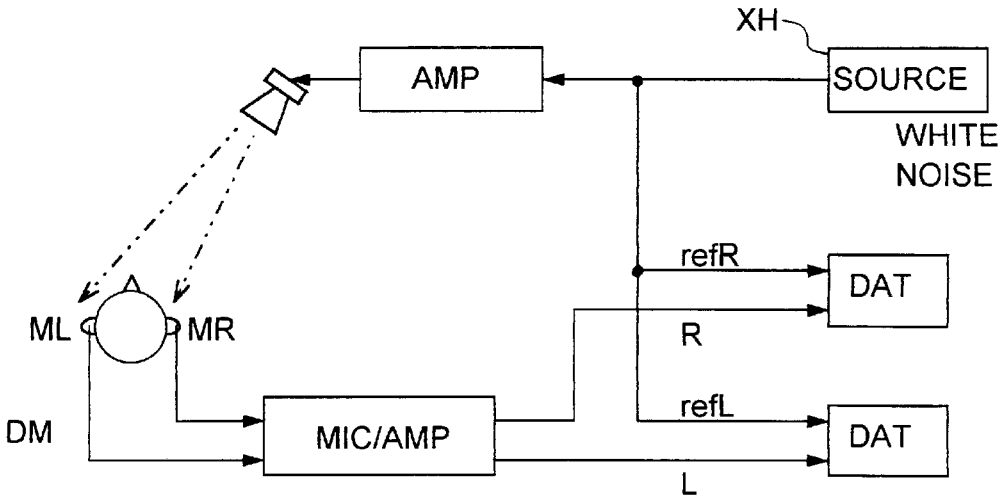
Fig. 2 (PRIOR ART)
FIG. 2 shows a measuring system of sound image.
Figures 3A, 3B, 3C:
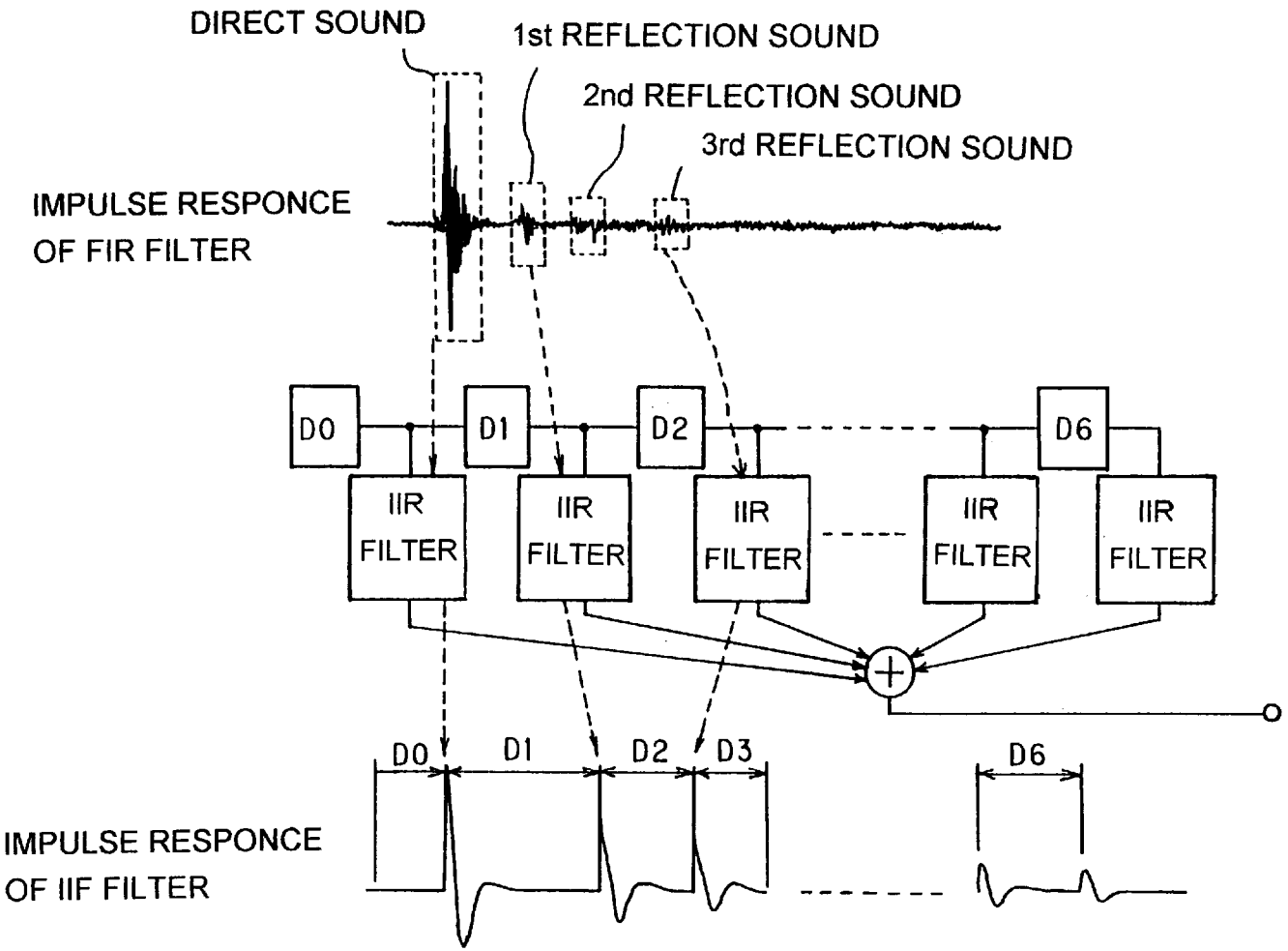
Fig. 3(A) (PRIOR ART)
Fig. 3(B) (PRIOR ART)
Fig. 3(C) (PRIOR ART)
FIGS. 3(A) to 3(C) show a general construction of a system for simulating a reflection sound structure in an echo room and adding reflection sounds to a direct sound.

In using this analysis, a desired impulse response is calculated by multiplying the HRTF obtained by the measurement system shown in FIG. 2 with an inverse characteristics of a headphone.

The measuring conditions in this case are as follows:

head for HRTF measurement:

dummy head (having conchae obtained by molding of actual ears) positions of microphones:

in the vicinity of respective eardrums position of desired localization:

30 degrees left of and 2 meters from a listener measuring place:

relatively dead room (area being about 33 square meters) inverse characteristics of headphone:

obtained by least squares method of an average characteristics of 3 kinds of ear-protector type headphone impulse response time:

about 93 ms (corresponding to 4096 samples at sampling frequency=44.1 kHz)

Figure 5:
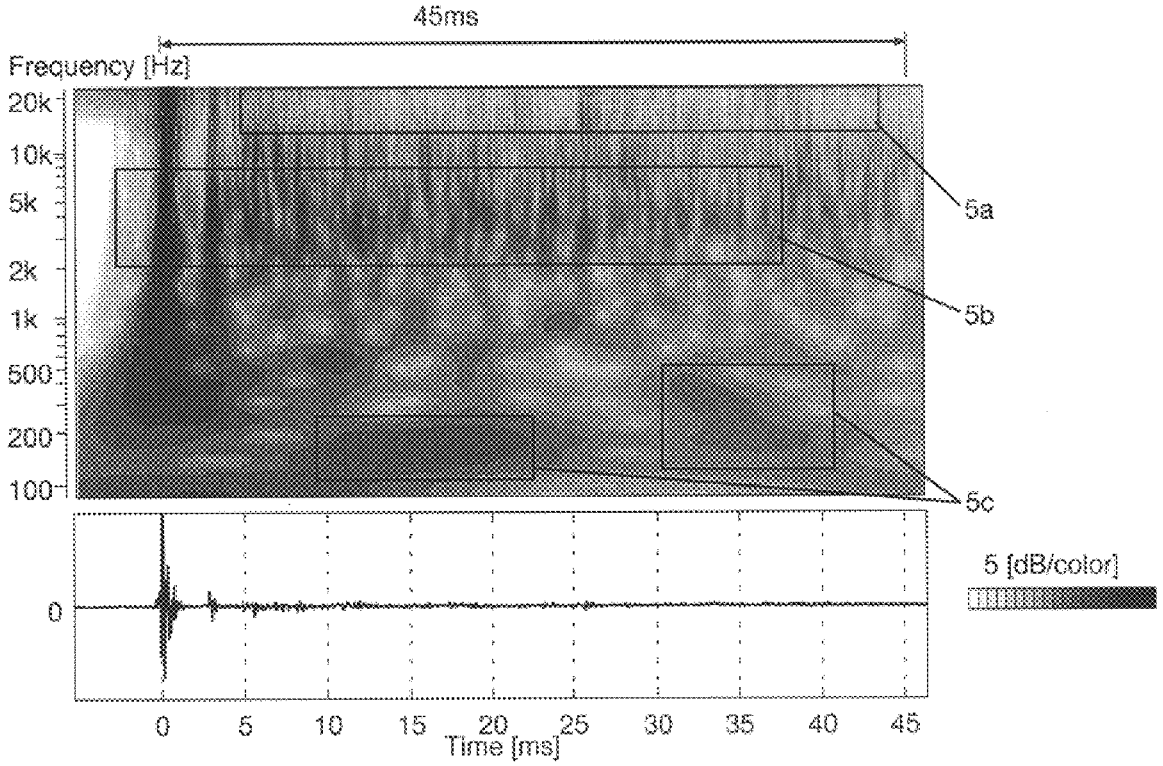
FIG. 5 shows a waveform of an aimed impulse response converted by the wavelet analysis.

FIG. 5 shows a waveform obtained by converting the thus obtained desired impulse response by means of the wavelet analysis.

It is clear from the waveform shown in FIG. 5 that the desired impulse response has the following features:

(1) Effective time length of reflection sound is about 45 ms.

(2) Direct sound contains many high frequency components, while reflection sound has substantially no high frequency component having frequency not lower than 10 kHz (see FIGS. 5, 5*a*).

(3) low frequency from 100 Hz to 400 Hz is distributed in time ranges from 10 to 25 ms and from 30 to 40 ms (see FIGS. 5, 5*c*).

(4) Both direct and reflection sounds contain components having frequency from 2 kHz to 6 kHz (these components are distributed laterally on the wavelet-converted waveform) (see FIGS. 5, 5*b*).

From this result of analysis, the following can be said:

(i) from (1), in order to obtain a similar distance feeling to the desired impulse response, a response time length, that is, the reverberation time, in the order of 45 ms is necessary.

(ii) from (2), high frequency components of the reflection sounds are substantially attenuated due to an influence of reflection at walls and diffraction of the head portion.

(iii) from (3), low frequency residual sound in the room itself is observed with delay. This low frequency sound has a factor of standing sound in the room.

(iv) from (4), resonance portions of external auditory miatuses of HRTF are common for every reflection sound.

The present invention is based of the result of analysis mentioned above. A construction of the present invention will now be described with reference to FIG. 6 which is a schematic block diagram of a sound image localization control device according to a first embodiment of the present invention.

Figure 6:
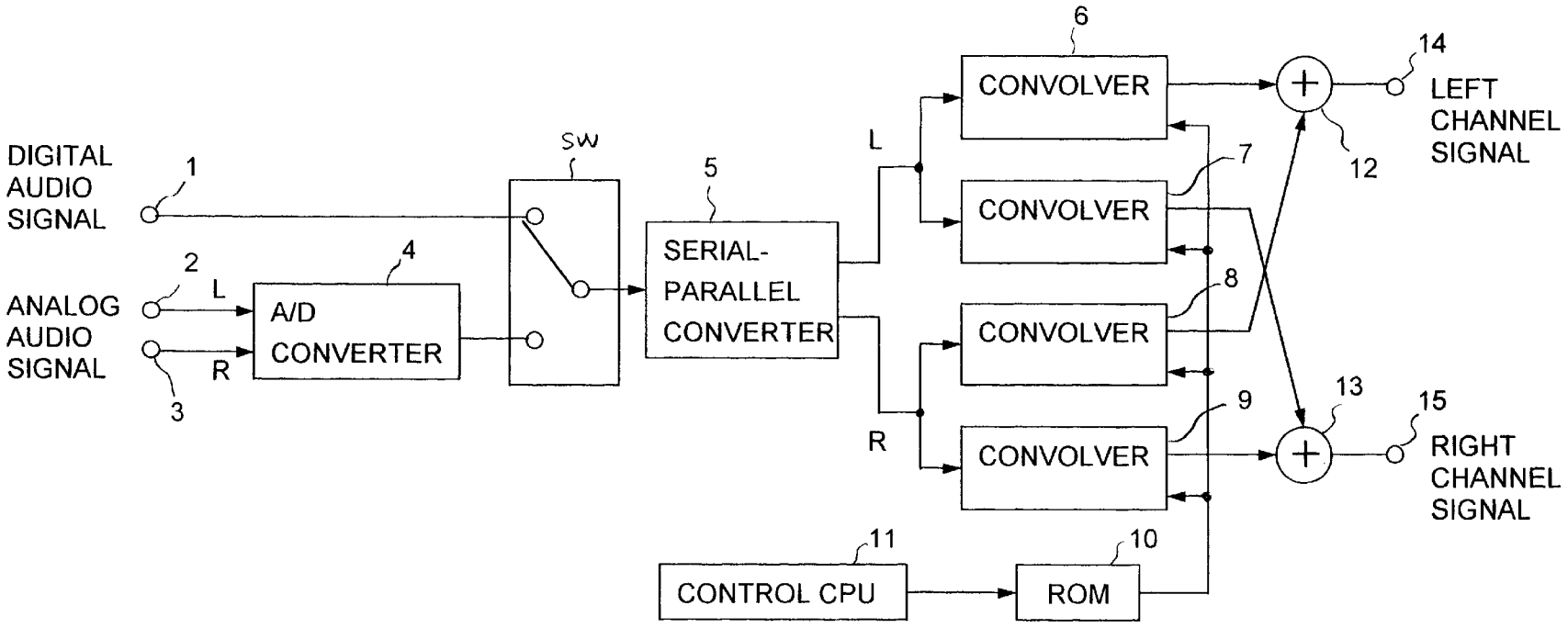
FIG. 6 is a block circuit diagram of a sound image localization control device according to a first embodiment of the present invention.

The device shown in FIG. 6 may be used in a TV, a game machine, etc. A pair of speakers SP1 and SP2 are arranged in a front of a listener with 30 degrees left and right with respect to the listener, respectively. Alternatively, a headphone may be used instead of the speakers SP1 and SP2.

Reference numerals 1, 2 and 3 denote input terminals for an acoustic signal incoming from a sound source. In a case where the incoming acoustic signal is a digital signal, the digital acoustic signal input to the input terminal 1 is directly supplied to a terminal a of a switch SW. In case where the incoming acoustic signal is an analog signal, a left and right channel acoustic signals input to the respective input terminals 2 and 3 are supplied to an A/D converter 4. A digital acoustic signal output from the A/D converter 4 is supplied to a terminal b of the switch SW. The digital acoustic signal from the input terminal 1 and the digital acoustic signal from the A/D converter 4 are switched selectively by the switch SW and the selected acoustic signal is supplied to a serial-parallel converter 5. The acoustic signal is converted into parallel signals which are supplied to paired left channel convolvers 6 and 7 and paired right channel convolvers 8 and 9, respectively.

On the other hand, the sound image localization control device includes a control CPU 11 and an ROM 10 storing coefficients, that is, simulated delay times and filtering characteristics, corresponding to predetermined angular positions obtained by the above mentioned measuring system. Upon a reception of a control signal supplied from the control CPU 11, the ROM 10 supplies the coefficients corresponding to the predetermined angular positions to the respective paired convolvers 6, 7, 8 and 9.

The respective convolvers 6, 7, 8 and 9 perform convolution processing on a time axis on the basis of the coefficients supplied from the ROM 10. Output signals of the convolvers 6 and 8 are added to each other by an adder 12 and a resultant sum is output from an output terminal 14. In the same manner, output signals of the convolvers 7 and 9 are added by an adder 13 and a resultant sum is output from an output terminal 15. The signals from the output terminals 14 and 15 are converted into analog signals by D/A converters (not shown), respectively, and supplied to speakers or a headphone.

A construction of the convolvers 6, 7, 8 and 9 which is the feature of the present invention will be described in detail by taking the convolver 6 as an example.

Figure 7:
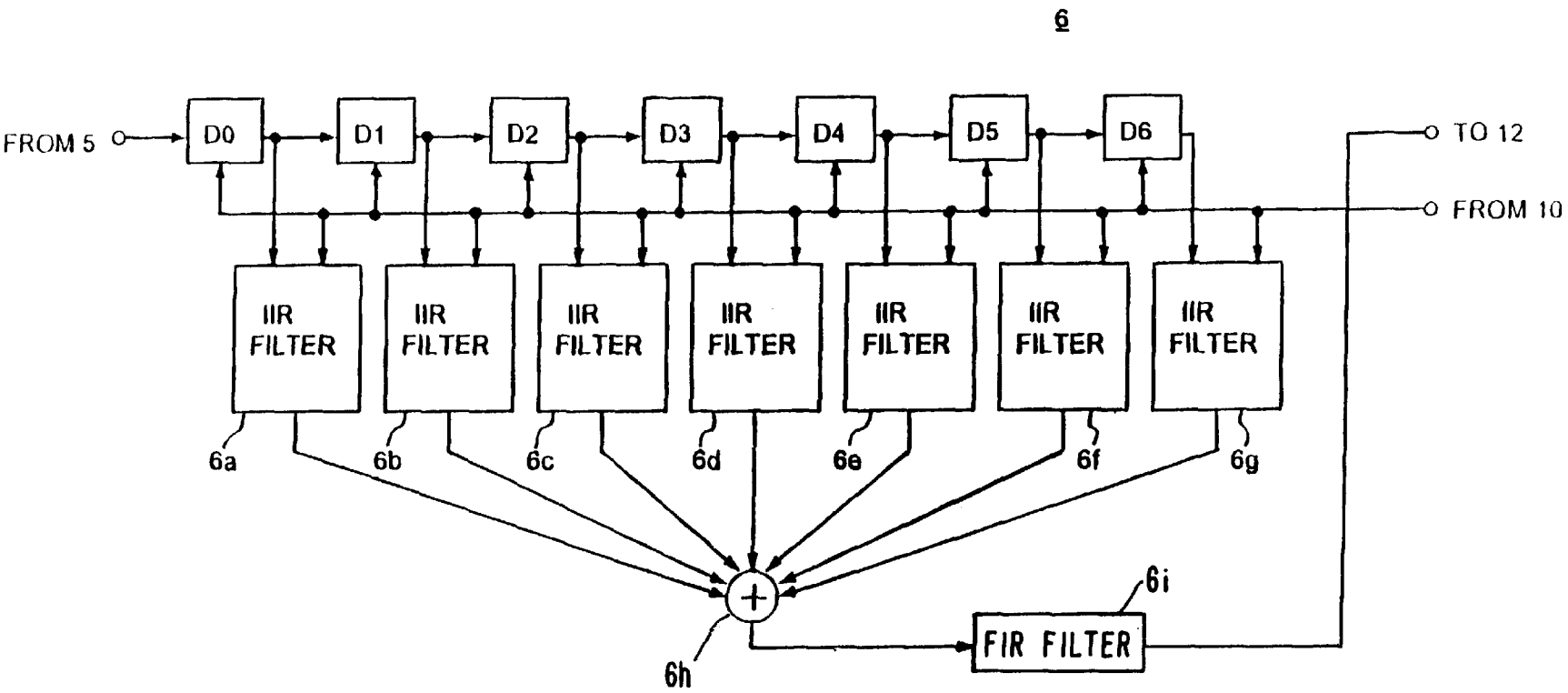
FIG. 7 is a detailed block diagram of a convolver 6 shown in FIG. 6.

FIG. 7 is a detail block diagram of the convolver 6. In FIG. 7, delay elements D0–D6 are connected in series. Delay times measured from an output of the delay element D0, that is, a direct sound, to outputs of the respective delay elements D1–D6 correspond to reflection sounds from 6 planes of a room in which the simulation is performed, respectively. The delay times of the delay elements are set by the respective coefficients, representing the simulated delay times, from the ROM 10 shown in FIG. 6.

The outputs of the delay elements D0–D6 are connected to inputs of a direct sound IIR filter 6*a*, a first reflection sound IIR filter 6*b*, a second reflection IIR filter 6*c*, a third reflection sound IIR 6*d*, a fourth reflection sound IIR filter 6*e*, a fifth reflection sound IIR filter 6*f* and a sixth reflection sound filter 6*g*, respectively. The IIR filters 6*a*–6*g* are supplied with the respective coefficients from the ROM 10 shown in FIG. 6. The characteristics of the IIR filters 6*a*–6*g* are set by the respective coefficients based on the simulated filtering characteristics.

Figure 8:
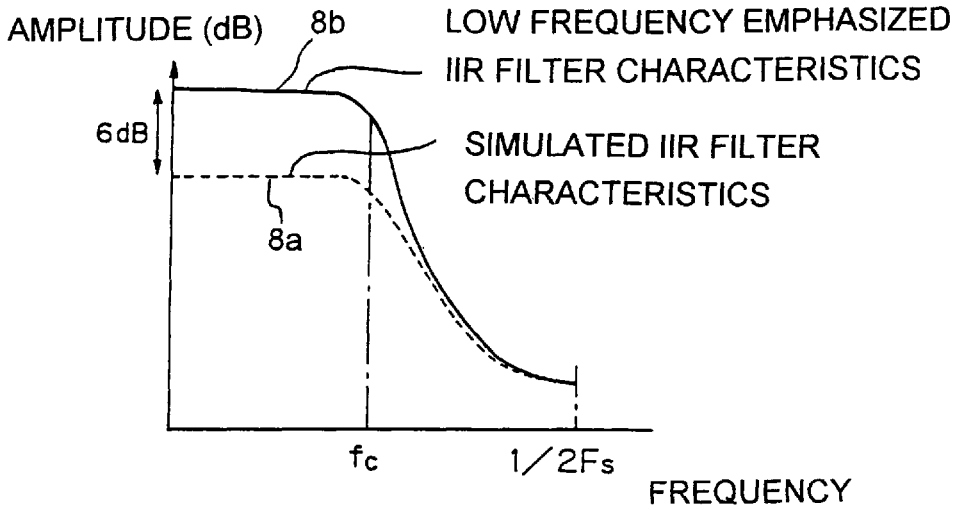
FIG. 8 is a graph showing a filtering characteristics of an IIR filter shown in FIG. 7.

FIG. 8 shows a filtering characteristics of the third reflection sound IIR filter 6*d*, for example. A dotted curve 8*a* is a simulated characteristics of the third reflection sound IIR filter 6*d*, which is based of the result of analysis mentioned above. And a solid curve 8*b* is a real filtering characteristics of the third reflection sound IIR filters 6*d*, which is set by ROM 10. It is clear from FIG. 8 that the characteristics 8*b* is emphasized compared with the characteristics 8*a* not higher than a certain constant frequency fc, for example, 600 Hz. The characteristics of the direct sound IIR filter 6*a*, the first reflection sound IIR filter 6*b* and the second reflection sound IIR filter 6*c* are set the simulated characteristics respectively by the ROM 10. The characteristics of the fourth to sixth reflection sound IIR filters 6*e* to 6*g* are set the characteristics which is emphasized by about 6 dB in a low frequency range compared with the simulated characteristics respectively, similarly to the real filtering characteristic of the third reflection sound IIR filter 6*d*.

That is, since it is found from the result of analysis mentioned previously that the low frequency components in the range 100–400 Hz are distributed in time domains 10–25 ms and 30–40 ms, the filtering characteristics of the filters corresponding to such delay times, for example, the third, fourth, fifth and sixth reflection sound IIR filters 6*d*–6*g* are made different from those of the result of the simulation.

Further, the last stage filter, that is, the sixth reflection IIR filter 6*g* is located in a position which is delayed from the direct sound by 35 ms. This is because it has been found by the present inventors that, when the low frequency side is emphasized by locating the last filter in a position which is delayed from the direct sound by an amount exceeding 35 ms, reflection sounds are increased, resulting in unnatural sound.

The output signals from the filters 6*a*–6*g* are added by an adder 6*h*. An output of the adder 6*h* is supplied to an FIR filter 6*i* having short tap length (for example, 30 taps).

Figure 9A:
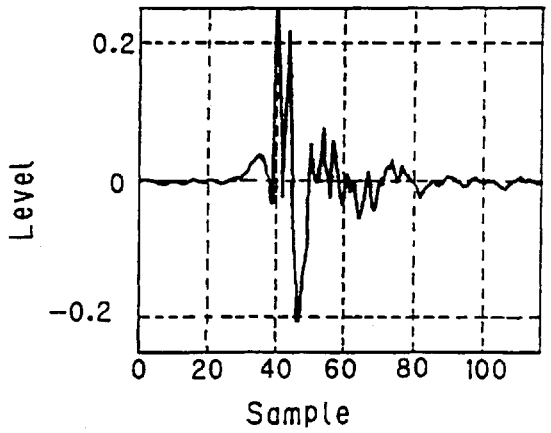
FIG. 9(A) is a graph showing an impulse response characteristics of the FIR filter shown in FIG. 7.
Figure 9B:
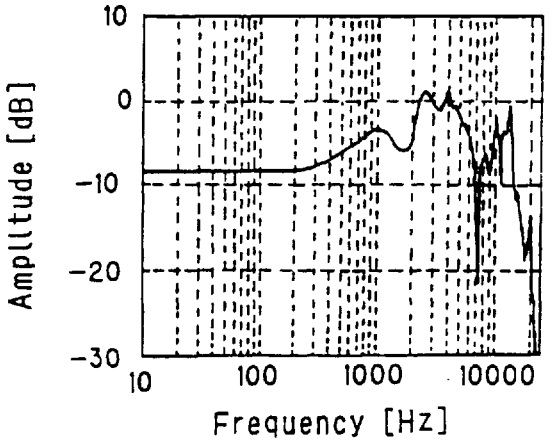
FIG. 9(B) is a graph showing a frequency vs. amplitude characteristics of the FIR filter shown in FIG. 7.

FIG. 9(A) shows an impulse response characteristics of the FIR filter 6*i* and FIG. 9(B) shows an amplitude-frequency characteristics of the FIR filter 6*i*. The impulse response of the FIR filter 6*i* corresponds to a direct sound component of the desired impulse response. In order to restrict the rise of the sound image, the frequency-amplitude characteristics of the FIR filter 6*i* is set to have a sharp valley in the vicinity of 8 kHz.

Although the response time of the FIR filter 6*i* is as short as 116 samples, it is possible to incorporate the characteristics of HRTF in the sound range covering the direct sound and all reflection sounds by providing the FIR filter 6*i* after the IIR filters 6*a*–6*g*. That is, it is possible to add the resonance components of the external auditory miatuses to the characteristics of the FIR filter 6*i*.

In this embodiment, the delay times of the respective delay elements D0–D6 and the response times of the IIR filters 6*a*–6*g* and the FIR filter 6*i* are set such that the reverberation time of the output signal of the localization filter, that is, the convolver 6, becomes 45 ms. This is because it is clear from the previously mentioned result of analysis that, in order to obtain the distance feeling similar to the desired impulse response, the response time of the convolver should be as long as about 45 ms.

Figure 10:
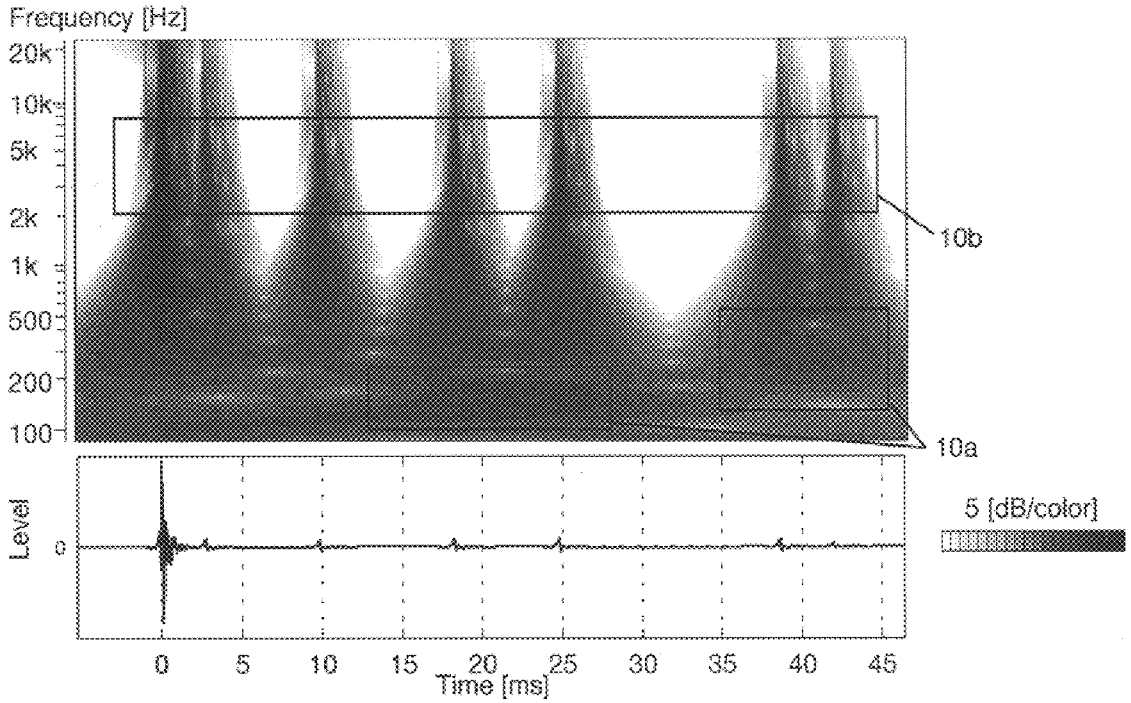
FIG. 10 shows a waveform of the impulse response waveform of the device according to the first embodiment of the present invention converted by the wavelet analysis.

FIG. 10 shows the impulse response waveform output from the FIR filter 6*i* and wavelet-converted. Comparing FIG. 10 with the desired wavelet-converted waveform shown in FIG. 6, it is clear that the low frequency sound has large delay time (FIGS. 10, 10*a*) and the high frequency portion of the direct sound and all of the reflection sounds which has frequency in the range 2–6 kHz is approximated to the desired wavelet-converted waveform (FIGS. 10, 10*a*).

The convolvers 7, 8 and 9 are identical to the convolver 6, respectively, with an exception that the filtering characteristics and the delay times of the convolvers 7, 8 and 9 are determined by the coefficients supplied from the ROM 10 shown in FIG. 6.

According to the first embodiment of the present invention, which is as simple in construction as 2 digital signal processor IC chips and in which the low frequency sound having large delay time is added, the distance feeling for the middle and high frequency sounds is improved and it is possible to obtain a realistic, natural and soft sound quality including the resonance components of external auditory miatuses by providing the FIR filter containing the HRTF component in the stage after the last IIR filter stage. Further, according to this embodiment, the sound image of sound localized in front of the listener is lowered, resulting in an increased distance feeling of the sound image.

Figure 11:
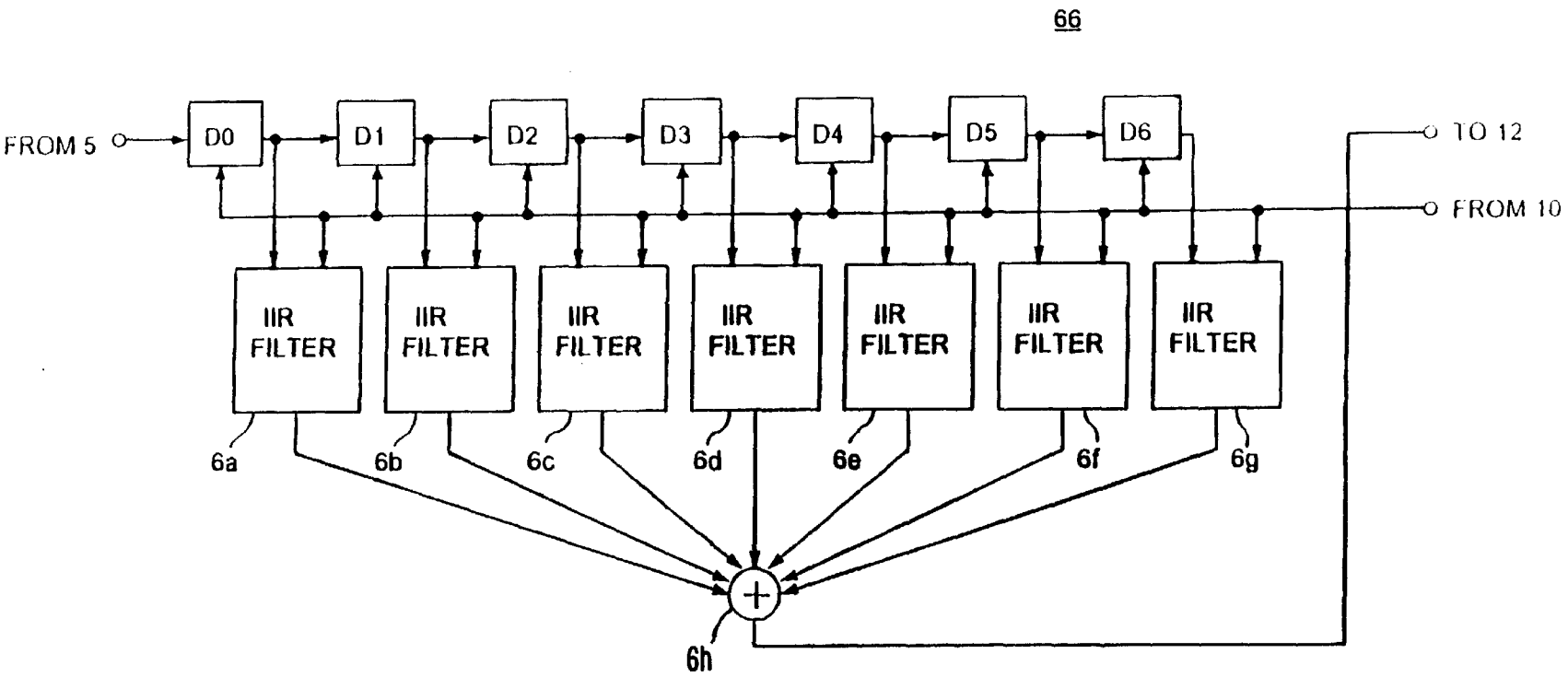
FIG. 11 is a block diagram of a sound image localization control device according to a second embodiment of the present invention.

FIG. 11 is a schematic block diagram of the sound image localization control device according to a second embodiment of the present invention. The second embodiment differs from the first embodiment in that, although, in the first embodiment, the convolver 6 includes the FIR filter **6*i* for adding the resonance components of the external auditory miatuses, a convolver 66 of the second embodiment does not include such FIR filter and, instead, delay times of respective delay elements D0–D6 and impulse response times of respective IIR filters 6*a*–6*g* are set such that reverberation time of an output of the convolver 66** becomes about 45 ms. Although, in the second embodiment, the emphasis of the middle frequency component is somewhat reduced, the distance feeling is increased and the rise of the sound image is restricted, compared with the conventional device, and its construction becomes simpler compared with the first embodiment.

What is claimed is:

1. A sound image localization control device for reproducing, from separated transducers, an acoustic signal on the basis of a plurality of simulated delay times and a plurality of simulated filtering characteristics as if a sound image were located in an arbitrary position other than the positions of the separately arranged transducers, comprising:

delay means having a plurality of delay elements having the plurality of simulated delay times for delaying an audio signal to constitute the acoustic signal with a direct sound signal and a plurality of reflection sound signals related to the direct sound signal;

a plurality of IIR filter means for filtering the direct sound signal and the plurality of the reflection sound signals obtained by the plurality of the delay elements of the delay means on the basis of the plurality of simulated filtering characteristics respectively, the plurality of the IIR filter means including filters having filtering characteristics which emphasize the lower frequency portion of predetermined reflection sound signals among the plurality of the reflection sound signals compared with the plurality of simulated filtering characteristics corresponding to the predetermined reflection sound signals; and adder means for adding output signals of the plurality of the IIR filter means, wherein the predetermined delay time and the impulse response times of the plurality of said IIR filter means are set such that reverberation time at the output of said adder means becomes substantially 45 ms, and wherein said filter of the plurality of said IIR filter means, having the filtering characteristic which emphasizes the lower frequency portion of the reflection sound signal compared with the simulated filtering characteristic corresponding to the reflection sound signal is provided at a position corresponding in delay time to substantially 35 ms.

2. A sound image localization control device as claimed in claim 1, wherein the filtering characteristics emphasize the lower frequency side of the predetermined reflection sound signals by about 6 dB compared with the plurality of simulated filtering characteristics corresponding to the predetermined reflection sound signals.

3. A sound image localization control device for reproducing, from separated transducers, an acoustic signal on the basis of a plurality of simulated delay times and a plurality of simulated filtering characteristics as if a sound image were located in an arbitrary position other than the positions of the separately arranged transducers, comprising:

delay means having a plurality of delay elements having the plurality of simulated delay times for delaying an audio signal to constitute the acoustic signal with a direct sound signal and a plurality of reflection sound signals related to the direct sound signal;

a plurality of IIR filter means for filtering the direct sound signal and the plurality of the reflection sound signals obtained by the plurality of the delay elements of the delay means on the basis of the plurality of simulated filtering characteristics respectively, the plurality of the IIR filter means including filters having filtering characteristics which emphasize the lower frequency portion of predetermined reflection sound signals among the plurality of the reflection sound signals compared with the plurality of simulated filtering characteristics corresponding to the predetermined reflection sound signals; and adder means for adding output signals of the plurality of the IIR filter means, and FIR filter means for filtering an output signal of said adder means, wherein the predetermined delay time, the impulse response times of the plurality of said IIR filter means and an impulse response time of said FIR filter means are set such that reverberation time at the output of said FIR filter means becomes 45 ms, and wherein said filter of the plurality of said IIR filter means, having the filtering characteristic which emphasizes the lower frequency portion of the reflection sound signal compared with the simulated filtering characteristic corresponding to the reflection sound signal is provided at a position corresponding in delay time to substantially 35 ms.

4. A sound image localization control device as claimed in claim 3, wherein the filtering characteristics emphasize the lower frequency side of the predetermined reflection sound signals by about 6 dB compared with the plurality of simulated filtering characteristics corresponding to the predetermined reflection sound signals.

* * * * *